US012630197B2

(12) United States Patent
Atake

(10) Patent No.: US 12,630,197 B2
(45) Date of Patent: May 19, 2026

(54) OVERHEAD TRANSPORT VEHICLE SYSTEM

(71) Applicant: MURATA MACHINERY, LTD., Kyoto (JP)

(72) Inventor: Hidekazu Atake, Ise (JP)

(73) Assignee: MURATA MACHINERY, LTD., Kyoto (JP)

( * ) Notice: Subject to any disclaimer, the term of this patent is extended or adjusted under 35 U.S.C. 154(b) by 717 days.

(21) Appl. No.: 18/105,904

(22) Filed: Feb. 6, 2023

(65) Prior Publication Data

US 2023/0257004 A1 Aug. 17, 2023

(30) Foreign Application Priority Data

Feb. 16, 2022 (JP) ..... 2022-022073

(51) Int. Cl.
*B61B 3/00* (2006.01)
*B61B 1/00* (2006.01)

(52) U.S. Cl.
CPC . *B61B 3/00* (2013.01); *B61B 1/00* (2013.01)

(58) Field of Classification Search
CPC ..... B61B 1/00; B61B 3/00; B61B 3/02
See application file for complete search history.

(56) References Cited

U.S. PATENT DOCUMENTS 8,267,633 B2 * 9/2012 Obikane ..... H01L 21/67772 414/217
9,561,910 B1 * 2/2017 Orsini ..... B65G 19/02
10,507,846 B2 * 12/2019 Meissner ..... B61B 3/00
10,957,569 B2 * 3/2021 Tawyer ..... H01L 21/67733
11,142,219 B2 * 10/2021 Takai ..... B65G 1/04
11,515,186 B2 * 11/2022 Yuasa ..... H01L 21/67769
11,615,975 B2 * 3/2023 Wada ..... H01L 21/67724 414/266
12,286,306 B2 * 4/2025 Hsu ..... H01L 21/6773
2012/0118845 A1 * 5/2012 Wada ..... H01L 21/6773 212/71
2022/0073275 A1 * 3/2022 Wada ..... H01L 21/6773
2022/0081207 A1 * 3/2022 Wada ..... H01L 21/67733
2023/0257004 A1 * 8/2023 Atake ..... B61B 1/00 104/91

FOREIGN PATENT DOCUMENTS

CN 109415163 B * 12/2020 ..... B65G 1/04
CN 116605603 A * 8/2023 ..... B65G 35/00
JP 2007209064 A * 8/2007
JP 2011032001 A * 2/2011
TW 1734862 B * 8/2021 ..... H01L 21/67706
TW 1758504 B * 3/2022 ..... H01L 21/67727
TW 1762735 B * 5/2022 ..... H01L 21/6773
TW 202442571 A * 11/2024 ..... B65G 1/04
TW 1899459 B * 10/2025

* cited by examiner

*Primary Examiner* — Jason C Smith

(74) *Attorney, Agent, or Firm* — Keating & Bennett, LLP

(57) ABSTRACT

An overhead transport vehicle system includes an upper track, a lower track below the upper track in the vertical direction, and a transport vehicle to travel along the upper track and the lower track. The overhead transport vehicle system includes a placement portion on the upper surface of the lower track and to which an article can be transported from the transport vehicle stopped on the upper track.

6 Claims, 6 Drawing Sheets

OVERHEAD TRANSPORT VEHICLE SYSTEM

CROSS REFERENCE TO RELATED APPLICATIONS

This application claims the benefit of priority to Japanese Patent Application No. 2022-022073 filed on Feb. 16, 2022. The entire contents of this application are hereby incorporated herein by reference.

BACKGROUND OF THE INVENTION

1. Field of the Invention

One aspect of the present invention relates to an overhead transport vehicle system.

2. Description of the Related Art

There is known an overhead transport vehicle system that includes an overhead transport vehicle including a traveling part that travels on a track laid on a ceiling or the like and a lift part that has a grip part for transferring an article to a placement part such as a buffer or a load port, a track on which the overhead transport vehicle travels, and a placement part provided along the track. The placement part provided in such an overhead transport vehicle system is a portion where an article being transported by the transport vehicle is temporarily placed or temporarily stored when the article cannot be transferred to an intended delivery port due to, for example, another article being placed on the delivery port.

SUMMARY OF THE INVENTION

For example, Japanese Patent No. 5339167 discloses an overhead transport vehicle system including an upper track on which an overhead transport vehicle travels, a lower track that is disposed below the upper track and on which the overhead transport vehicle travels, and a placement part formed by hanging a support plate over a linking member linking a pair of hanging members that hang the lower track. However, in such a conventional overhead transport vehicle system, the placement part cannot be easily installed due to the need for installing the placement part by hanging the support plate, which is a separate member, over the hanging members at a high place.

Therefore, preferred embodiments of the present invention provide overhead transport vehicle systems in each of which an article placement portion can be easily installed to extend along a track.

An overhead transport vehicle system according to one aspect of a preferred embodiment of the present invention is an overhead transport vehicle system including an upper track, a lower track below the upper track in a vertical direction, and an overhead transport vehicle to travel along the upper track and the lower track. The overhead transport vehicle system includes a placement portion on an upper surface of the lower track and to which an article is transferable from the overhead transport vehicle stopped on the upper track.

In the overhead transport vehicle system having this configuration, the placement portion is provided on the upper surface of the lower track provided in advance. As described above, when the placement portion is directly provided on the upper surface of the track, the workability at the time of installation is more excellent than when the placement portion is provided using a hanger or the like hung from the ceiling. Therefore, it is possible to easily install the article placement portion provided along the track.

In an overhead transport vehicle system according to one aspect of a preferred embodiment of the present invention, the lower track does not overlap the upper track in plan view as viewed from the vertical direction. With this configuration, it is possible to exchange an article between the overhead transport vehicle traveling on the upper track and the overhead transport vehicle traveling on the lower track via one placement portion.

In an overhead transport vehicle system according to one aspect of a preferred embodiment of the present invention, the lower track includes a pair of bottom plates spaced from each other in a width direction orthogonal to both an extending direction and a vertical direction of the track, a pair of side plates extending from the pair of bottom plates, respectively, and an upper plate that connects the pair of side plates in the width direction and defines the upper surface, and the traveling portion of the overhead transport vehicle is operable to travel in a space surrounded by the pair of bottom plates, the pair of side plates, and the upper plate. With this configuration, the placement portion is provided on the upper plate of the track to enclose the traveling portion of the overhead transport vehicle, so that it is possible to ensure enough space for the placement of the article and to place the article in a stable state.

In an overhead transport vehicle system according to one aspect of a preferred embodiment of the present invention, the upper surface of the lower track includes a protrusion to position the article at a placement position. As a result, it is possible to place the article in a stable state at a predetermined position on the upper surface of the lower track.

In an overhead transport vehicle system according to one aspect of a preferred embodiment of the present invention, the protrusion is attached to a groove extending along an extending direction of the lower track on the upper surface of the lower track. With this configuration, it is possible to provide the protrusion that positions the article at the placement position by simple work of attaching the protrusion to the groove.

In an overhead transport vehicle system according to one aspect of a preferred embodiment of the present invention, the lower track is attached to a hanger that hangs and supports the lower track via an inclination adjustment tool. With this configuration, it is possible to easily adjust the inclination of the lower track with respect to the horizontal plane, and thus the inclination of the article placed on the upper surface of the lower track with respect to the horizontal plane.

In an overhead transport vehicle system according to one aspect of a preferred embodiment of the present invention, the lower track is attached to a hanger that hangs and supports the lower track via an elastic body. With this configuration, it is possible to reduce or prevent vibration generated in the lower track by the transport vehicle traveling on the lower track.

An overhead transport vehicle system according to one aspect of a preferred embodiment of the present invention may further include a fall prevention fence that extends laterally relative to the article placed on the upper surface of the lower track and along an extending direction of the lower track, and is attached to the lower track. With this configuration, the fall prevention fence is attached to the lower track instead of being attached to the ceiling or the like via the hanger or the like, and can thus be installed easily.

According to preferred embodiments of the present invention, it is possible to easily install the article placement portion along the track.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
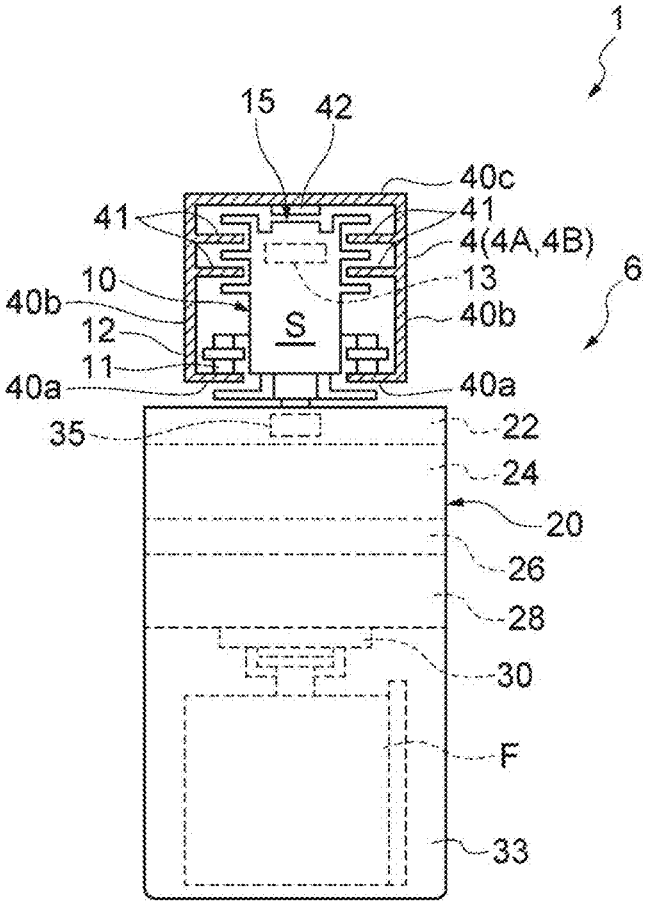
FIG. 1 is a diagram illustrating a schematic configuration of an overhead transport vehicle and a cross-sectional configuration of a track, the vehicle and the track defining an overhead transport vehicle system according to a preferred embodiment of the present invention.

Hereinafter, overhead transport vehicle systems according to preferred embodiments will be described with reference to the drawings. In descriptions of the drawings, the same elements are provided with the same reference numerals, and a repeated description is omitted.

Figure 2:
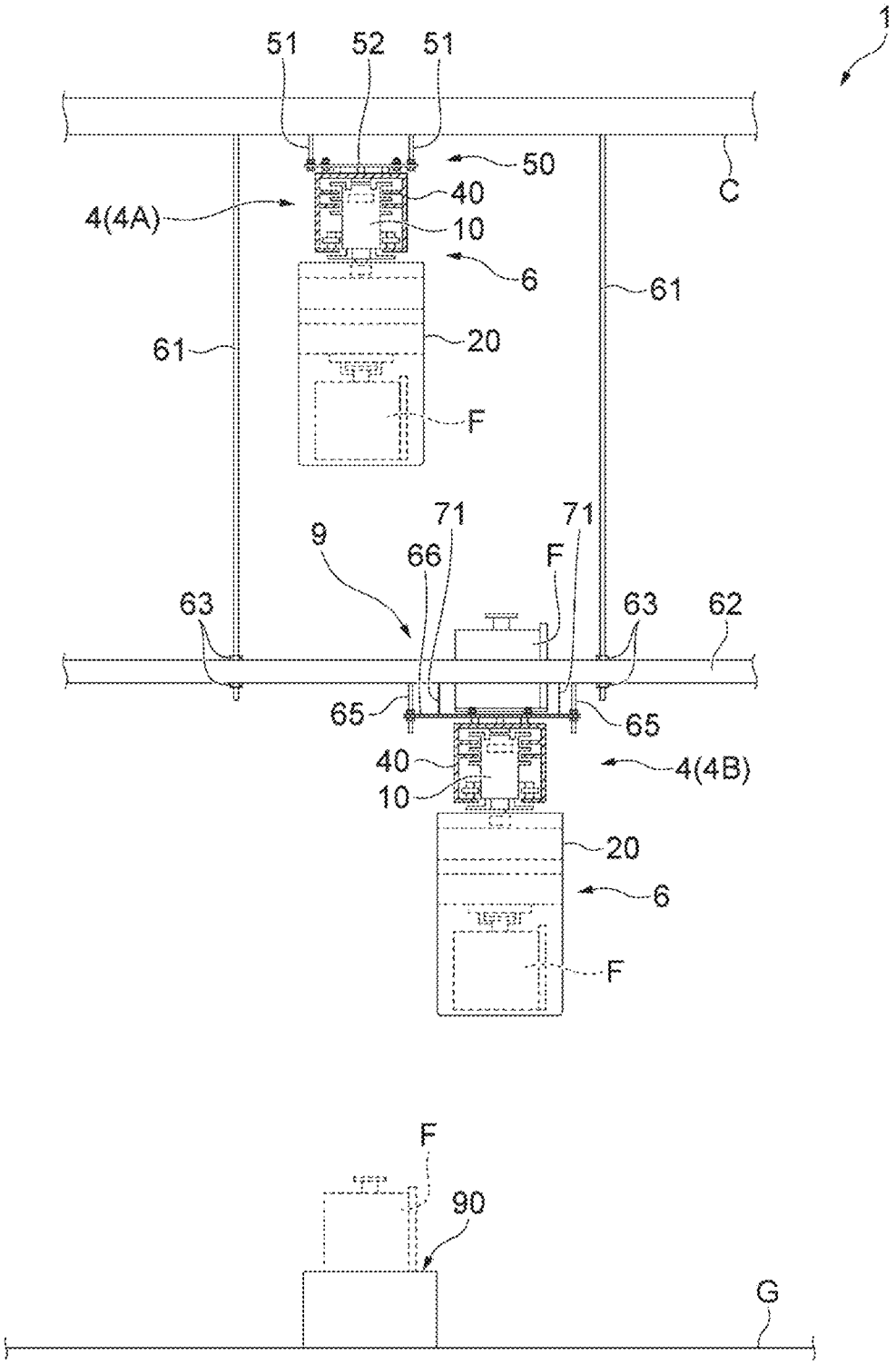
FIG. 2 is a front view illustrating configurations of an upper track and a lower track of an overhead transport vehicle system according to a preferred embodiment of the present invention.

As illustrated in FIGS. 1 and 2, an overhead transport vehicle system 1 is a system for transporting an article F between placement parts of a processing device or the like, for example, using an overhead transport vehicle 6 (Hereinafter, it is referred to as a "transport vehicle 6".) movable along a track 4. The article F includes, for example, a container such as a front opening unified pod (FOUP) that stores a plurality of semiconductor wafers and a reticle pod that stores a glass substrate, general components, and the like. The overhead transport vehicle system 1 mainly includes a plurality of transport vehicles 6, a track 4, a placement part 9, and a transport vehicle controller (not illustrated) configured or programmed control the transport of the plurality of transport vehicles 6.

The transport vehicle 6 travels along the track 4 and transports the article F. The transport vehicle 6 is configured to be able to transfer the article F. The number of transport vehicles 6 included in the overhead transport vehicle system 1 is not particularly limited but is plural. The transport vehicle 6 includes a traveling part 10, a body part 20, and a body controller 35.

The traveling part 10 causes the transport vehicle 6 to travel along the track 4. The traveling part 10 mainly includes a traveling roller 11, a side roller 12, a traveling drive part 13, and a power receiving device 15. The traveling roller 11 rolls on the bottom plate part 40*a* of the track 4. The traveling rollers 11 are arranged at both left and right ends of each of the front and rear of the traveling part 10. The side roller 12 is operable to contact a side plate part 40*b* of the track 4. The traveling drive part 13 is a linear DC motor (LDM) and is provided at the front and rear of the traveling part 10. The traveling drive part 13 is provided with an electromagnet, and the traveling drive part 13 generates a magnetic force for accelerating or braking the transport vehicle 6 between the electromagnet and a magnetic plate 42 disposed on the inner surface of an upper plate part 40*c* of the track 4. The power receiving device 15 is disposed so as to sandwich the traveling drive part 13 in the left-right direction at the front and rear of the traveling part 10 in plan view of the transport vehicle 6 as viewed from above in the vertical direction. In the power receiving device 15, power is supplied to a feeder (not illustrated) to be described later in a non-contact manner.

The body part 20 includes a body frame 22, a lateral transfer part 24, a 0 drive 26, a lift drive part 28, a lift stage 30, and a cover 33. The body frame 22 is connected to the traveling part 10 and supports a lateral transfer part 24, a 0 drive 26, a lift drive part 28, the lift stage 30, and the cover 33. The lateral transfer part 24 laterally transfers the 0 drive 26, the lift drive part 28, and the lift stage 30 all at once in a direction (width direction) perpendicular to the extending direction of the track 4. The 0 drive 26 rotates at least one of the lift drive part 28 and the lift stage 30 within a predetermined angle range in a horizontal plane. The lift drive part 28 lifts and lowers the lift stage 30 by winding or feeding a suspension material such as a wire, a rope, and a belt.

The lift stage 30 is provided with a chuck and can freely hold or release the article F. For example, a pair of covers 33 are provided in front of and behind the transport vehicle 6 in the traveling direction. The cover 33 causes a claw (not illustrated) or the like to protrude and retract to prevent the article F from falling during the transport. The body controller 35 is provided in the body part 20. The body controller 35 controls various operations in the transport vehicle 6.

The track 4 is laid, for example, near a ceiling, which is an overhead space of an operator. The track 4 is directly or indirectly hung from a ceiling C. In the present preferred embodiment, the track 4 includes an upper track 4A that is attached to the ceiling C and a lower track 4B that is hung from a beam member 62 hung from the ceiling C and is provided below the upper track 4A in the vertical direction. That is, the transport vehicle 6 traveling on the upper track 4A travels at a position higher than the transport vehicle 6 traveling on the lower track 4B. The lower track 4B is disposed at a position not overlapping with the upper track 4A in plan view as viewed from the vertical direction. That is, the transport vehicle 6 traveling on the upper track 4A travels at a position shifted from the transport vehicle 6 traveling on the lower track 4B in the width direction. The hanging structure of the track 4 will be described in detail later.

The track 4 is a predetermined traveling path along which the transport vehicle 6 is able to travel. The track 4 includes a tubular rail body part 40 including a pair of bottom plate parts 40*a*, 40*a*, a pair of side plate parts 40*b*, 40*b*, and the upper plate part 40*c*, a feeder support part 41, and the magnetic plate 42. The rail body part 40 houses the traveling part 10 of the transport vehicle 6.

The bottom plate part 40*a* extends in the traveling direction of the transport vehicle 6 and defines the lower surface of the rail body part 40. The pair of bottom plate parts 40*a*, 40*a* are spaced from each other in the width direction orthogonal to both the extending direction of the track 4 and the vertical direction. The bottom plate part 40*a* is a plate for the traveling roller 11 of the transport vehicle 6 to roll and travel on. The side plate part 40*b* extends in the traveling direction of the transport vehicle 6 and constitutes the side surface of the rail body part 40. The side plate part 40*b* is extending from each of the pair of bottom plate parts 40*a*, 40*a*.

Figure 3:
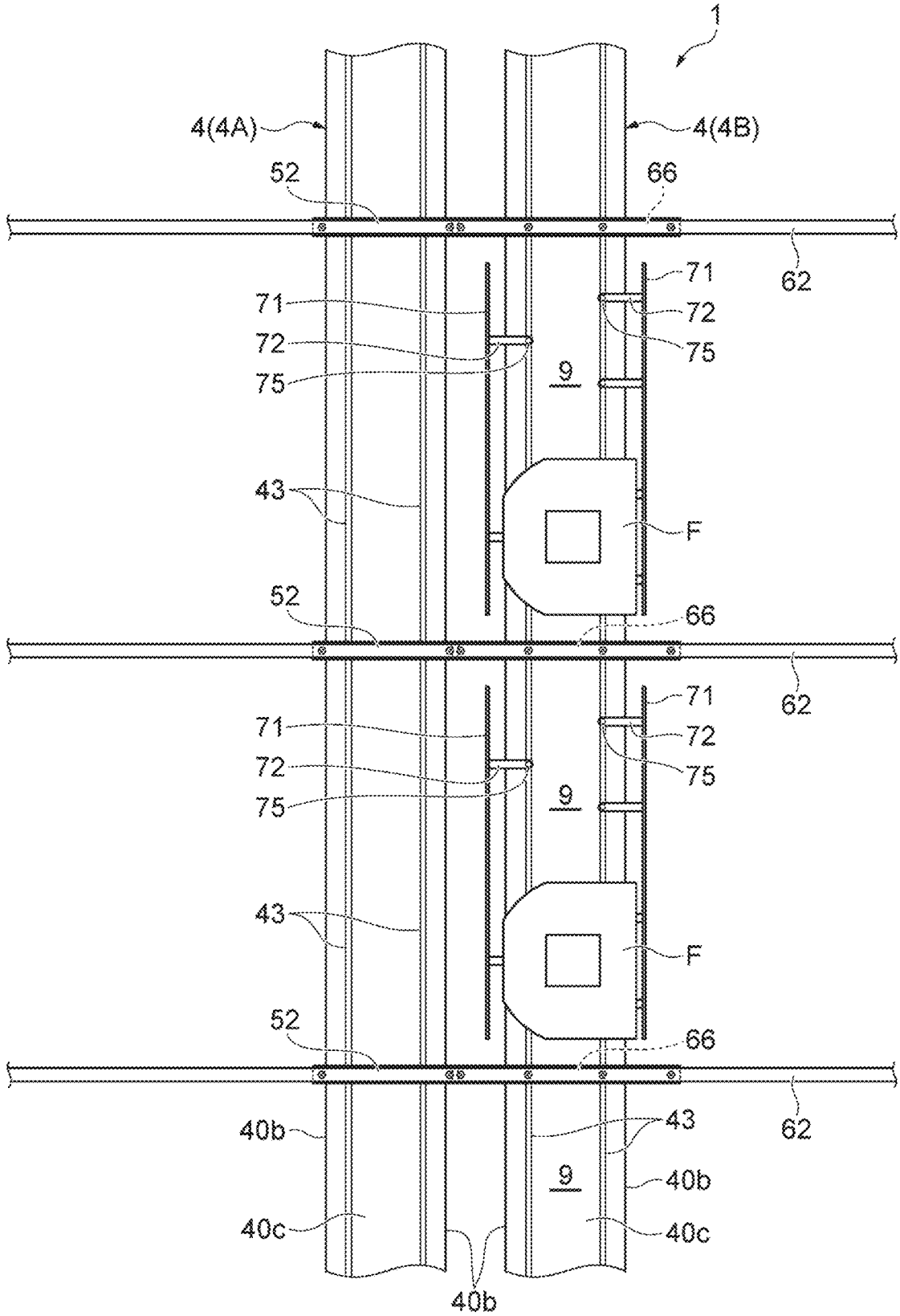
FIG. 3 is a plan view of configurations of the upper track and the lower track of FIG. 2 in plan view.

The upper plate part 40*c* connects the pair of side plate parts 40*b*, 40*b* in the width direction and extends in the traveling direction of the transport vehicle 6 to define the upper surface of the rail body part 40. As illustrated in FIG. 3, an attachment groove (groove part) 43 extending along the extending direction of the track 4 (the traveling direction of the transport vehicle 6) is provided in the upper surface of the rail body part 40, that is, the outer surface of the upper plate part 40*c*. Two attachment grooves 43 are arranged in the width direction. The attachment groove 43 is provided for the attachment of an upper support member 52, a lower support member 66, a protrusion 75, an attachment member 72, and the like, which will be described in detail later, to the upper surface of the rail body part 40 (the outer surface of the upper plate part 40*c*).

The feeder support part 41 supports a feeder that supplies power to the transport vehicle 6. The feeder support part 41 may be fixed to each of the pair of side plate parts 40*b*, 40*b* and may extend along the extending direction of the rail body part 40 or may be spaced from each other. The magnetic plate 42 causes the traveling drive part 13 of the transport vehicle 6 to generate a magnetic force (thrust) for traveling or stopping. The magnetic plate 42 is fixed to the upper plate part 40*c* and extends along the traveling direction.

Figure 4A:
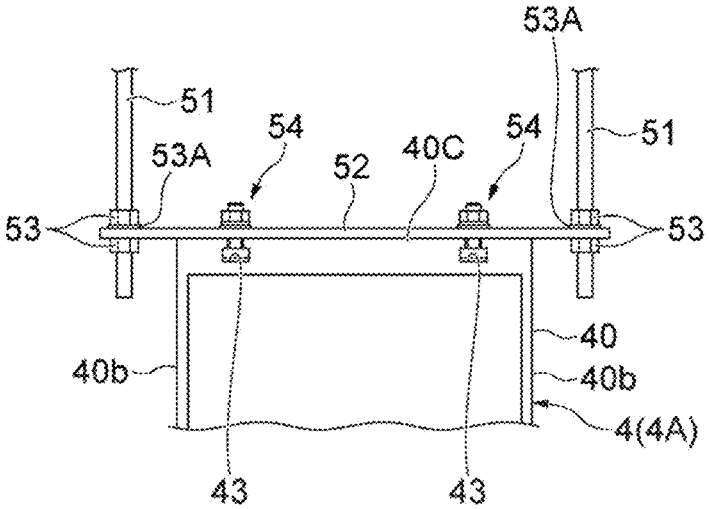
FIG. 4A is a front view illustrating an attachment configuration of the upper track.

Next, the hanging configuration of each of the upper track 4A and the lower track 4B will be described. As illustrated in FIGS. 2, 3, and 4A, in the upper track 4A, the rail body part 40 is hung from the ceiling C by the pair of upper hanging members 51, 51 and the upper support member 52. The upper ends of the pair of upper hanging members 51, 51 are fixed to the ceiling C. The upper support member 52 is a member that connects the lower ends of the upper hanging members 51, 51 to each other. The upper support member 52 is attached to the pair of upper hanging members 51, 51 via fastening members 53, 53 such as nuts. An elastic body 53A formed of a member such as a vibration-proof rubber or a spring may be disposed between the fastening members 53, 53 and the upper support member 52.

The pair of upper hanging members 51, 51 and the upper support member 52 are disposed at predetermined intervals along the extending direction of the track 4. The rail body part 40 is attached to the upper support member 52 via a fastening member 54 such as a bolt and a nut. As described above, the attachment groove 43 is formed on the outer surface of the upper plate part 40*c* of the rail body part 40. The fastening member 54 is provided in the attachment groove 43.

Figure 4B:
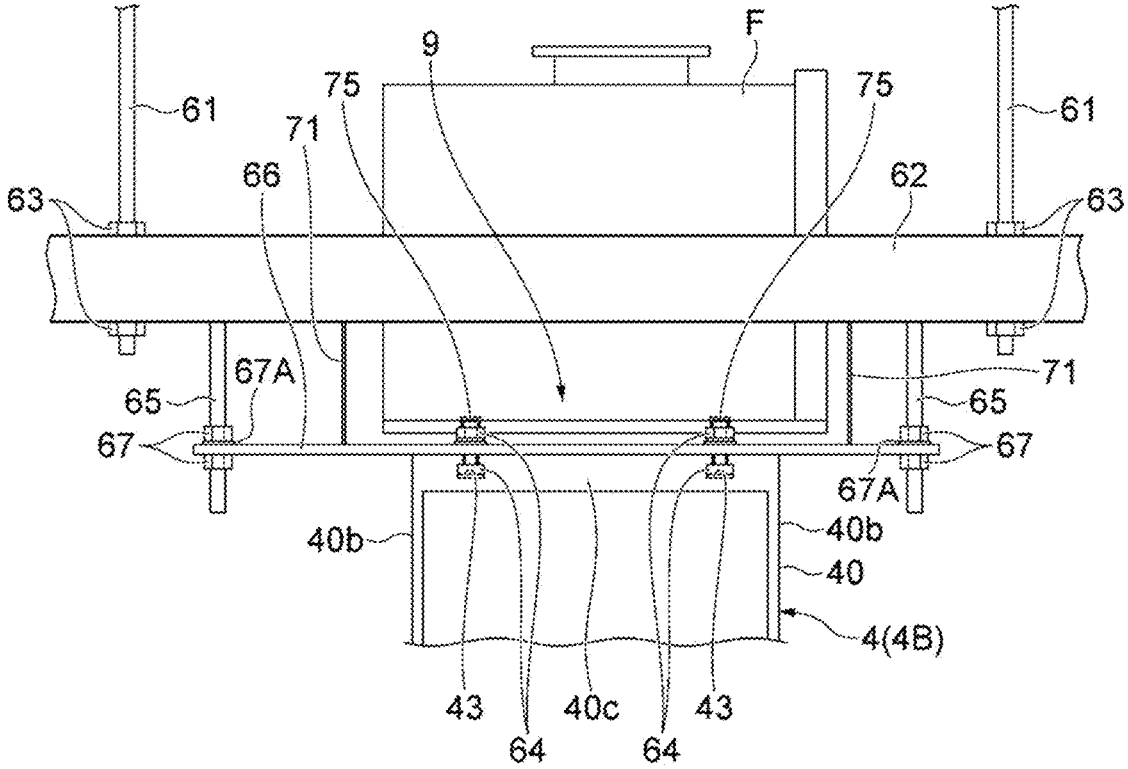
FIG. 4B is a front view illustrating an attachment configuration of the lower track.

As illustrated in FIGS. 2, 3, and 4B, in the lower track 4B, the rail body part 40 is hung from the beam member 62 hung from the ceiling C by hanging members 61, 61. The upper ends of the hanging members 61, 61 are fixed to the ceiling C. The beam member 62 is attached to the hanging members 61, 61 via fastening members 63, 63 such as bolts and nuts. More specifically, the rail body part 40 is hung from the beam member 62 by a pair of lower hanging members (hanging members) 65, 65 and the lower support member 66.

The upper ends of the pair of lower hanging members 65, 65 are fixed to the beam member 62. The lower support member 66 is a member that connects lower ends of the pair of lower hanging members 65, 65 to each other. The lower support member 66 is attached to the pair of lower hanging members 65, 65 via fastening members 67, 67 such as nuts. At least portions of the pair of lower hanging members 65, 65 are formed with spiral grooves that can be screwed into the fastening members 67, 67. That is, the fastening members 67, 67 are movable along the extending direction of the lower hanging member 65. As a result, the lower support member 66 can be fixed at an arbitrary position in the extending direction of the lower hanging member 65. That is, the pair of lower hanging members 65, 65 and the fastening members 67, 67 function as an inclination adjustment tool that adjusts the inclination of the lower support member 66 and thus the inclination of the lower track 4B. An elastic body 67A formed of a member such as a vibration-proof rubber or a spring may be disposed between the fastening members 67, 67 and the lower support member 66. The elastic body 67A may not be provided.

The pair of lower hanging members 65, 65 and the lower support member 66 are disposed at predetermined intervals along the extending direction of the track 4. The rail body part 40 is attached to the lower support member 66 via a bolt, a nut, and the like. The rail body part 40 is attached to the lower support member 66 via a fastening member 64 such as a bolt and a nut. As described above, the attachment groove 43 is formed on the outer surface of the upper plate part 40*c* of the rail body part 40. The fastening member 64 is provided in the attachment groove 43.

Figure 5:
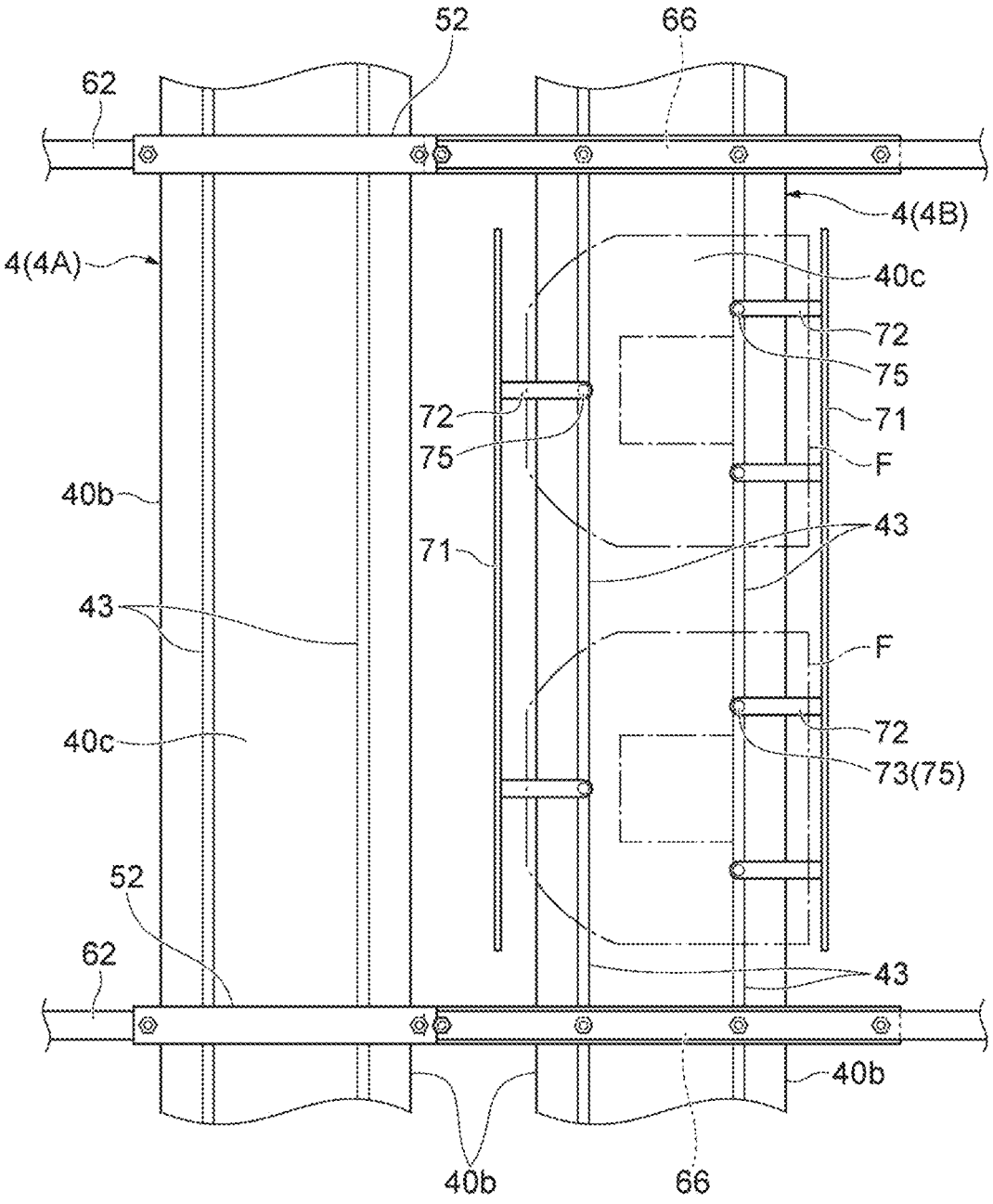
FIG. 5 is an enlarged plan view illustrating the plan view of FIG. 3 in an enlarged manner.

As illustrated in FIGS. 4B and 5, in the hanging configuration of the lower track 4B, which is the configuration thus described, the placement part 9, to which the article F can be transferred from the transport vehicle 6 stopped on the upper track 4A, is provided on the upper surface of the lower track 4B (the outer surface of the upper plate part 40*c*). The transport vehicle 6 feeds the lift stage 30 in the width direction by the lateral transfer part 24 and then lowers the lift stage 30 to place the article F on the placement part 9.

The placement part 9, which is the upper surface of the lower track 4B, is provided with a protrusion 75 to position the article F at the placement position. The protrusion 75 may be fixed to the attachment groove 43 via an elastic body formed by a member such as a vibration-proof rubber or a spring. The protrusion 75 is a protrusion that can be fitted into a recess formed on the bottom surface of the FOUP or the like. The protrusions 75 are provided corresponding to the number of recesses formed on the bottom surface of the article F such as the FOUP. In the present preferred embodiment, three protrusions 75 are provided for one article F. As illustrated in FIG. 3, the protrusion 75 is provided so that two articles F can be disposed between the lower support member 66 and the lower support member 66 disposed at equal intervals.

A fall prevention fence 71 to prevent the article F from falling from the placement part 9 is provided on the upper surface of the lower track 4B. The fall prevention fence 71 is a plate extending laterally to the article F placed on the upper surface of the lower track 4B and along the extending direction of the lower track 4B. The fall prevention fence 71 is attached via the attachment member 72 attached to the upper surface of the lower track 4B. In the present preferred embodiment, the attachment member 72 is integrally attached by the protrusion 75 fixed to the attachment groove 43 on the upper surface of the lower track 4B. Specifically, the attachment member 72 is fixed to the upper surface of the lower track 4B by being sandwiched between the protrusion 75 and the fastening member 64 that attaches the protrusion 75 to the attachment groove 43.

Functional effects of the overhead transport vehicle system 1 of the above preferred embodiment will be described. In the overhead transport vehicle system 1 of the above preferred embodiment, the placement part 9 is provided on the upper surface of the lower track 4B provided in advance. As described above, when the placement part 9 is directly provided on the upper surface of the track 4, the workability is more excellent than when the placement part is provided using a hanging member or the like hung from the ceiling C. Therefore, it is possible to easily install the placement part 9 for the article F provided along the track 4.

In the overhead transport vehicle system 1 of the above preferred embodiment, the lower track 4B is disposed at a position not overlapping with the upper track 4A in plan view as viewed from the vertical direction. As a result, the article F can be exchanged between the transport vehicle 6 traveling on the upper track 4A and the transport vehicle 6 traveling on the lower track 4B. For example, as illustrated in FIG. 2, when a placement part 90 disposed below the upper track 4A and at a position overlapping with the upper track 4A in plan view as viewed from the vertical direction is provided, the article F can be exchanged with the transport vehicle 6 traveling on the lower track 4B. Specifically, the transport vehicle 6 traveling on the upper track 4A can place the article F on the placement part 90 by stopping above the placement part 90 and lowering the lift stage 30. The transport vehicle 6 traveling on the lower track 4B can hold the article F placed on the placement part 90 by stopping above the placement part 90 and lowering the lift stage 30 after laterally transferring the lift stage 30.

In the overhead transport vehicle system 1 of the above preferred embodiment, the lower track 4B includes the pair of bottom plate parts 40*a*, 40*a* spaced from each other in the width direction, the pair of side plate parts 40*b*, 40*b* extending from the pair of bottom plate parts 40*a*, 40*a*, respectively and the upper plate part 40*c* that connects the pair of side plate parts 40*b*, 40*b* in the width direction and defines the upper surface. Then, the traveling part 10 of the transport vehicle 6 travels in a space S surrounded by the pair of bottom plate parts 40*a*, 40*a*, the pair of side plate parts 40*b*, 40*b*, and the upper plate part 40*c*. The placement part 9 of the present preferred embodiment is provided on the upper plate part 40*c* of the track 4 to enclose the traveling part 10 of the transport vehicle 6, so that it is possible to ensure enough space for the placement of the article F and to place the article F in a stable state.

In the overhead transport vehicle system 1 of the above preferred embodiment, the protrusion 75 to position the article F at the placement position is provided on the upper surface of the lower track 4B, and hence the article F can be placed in a stable state at a predetermined position on the upper surface of the lower track 4B.

In the overhead transport vehicle system 1 of the above preferred embodiment, the protrusion 75 is attached to the attachment groove 43 extending along the extending direction of the lower track 4B on the upper surface of the lower track 4B. Thus, the protrusion 75 to position the placement position of the article F can be easily formed only by attaching the protrusion 75 to the attachment groove 43.

In the overhead transport vehicle system 1 of the above preferred embodiment, the lower track 4B is attached to the lower hanging member 65 that hangs and supports the lower track 4B via the inclination adjustment tool (the pair of lower hanging members 65, 65 and the fastening members 67, 67). As a result, it is possible to easily adjust the inclination of the lower track 4B with respect to the horizontal plane, and thus the inclination of the article F placed on the upper surface of the lower track 4B with respect to the horizontal plane.

In the overhead transport vehicle system 1 of the above preferred embodiment, the lower track 4B is fixed to the lower support member 66 that is attached to the lower hanging member 65 hanging and supporting the lower track 4B via the elastic body 67A. As a result, it is possible to reduce or prevent vibration generated in the lower track 4B by the transport vehicle 6 traveling on the lower track 4B.

In the overhead transport vehicle system 1 of the above preferred embodiment, the fall prevention fence 71 extending laterally to the article F placed on the upper surface of the lower track 4B and along the extending direction of the lower track 4B is attached to the lower track 4B. The fall prevention fence 71 is attached to the lower track 4B instead of being attached to the ceiling C or the like via the hanging member or the like, and can thus be installed easily.

Preferred embodiments of the present invention have been described above, but the present invention is not limited to the above preferred embodiments. Various modifications can be made in a range not departing from the gist of the invention.

Figure 6:
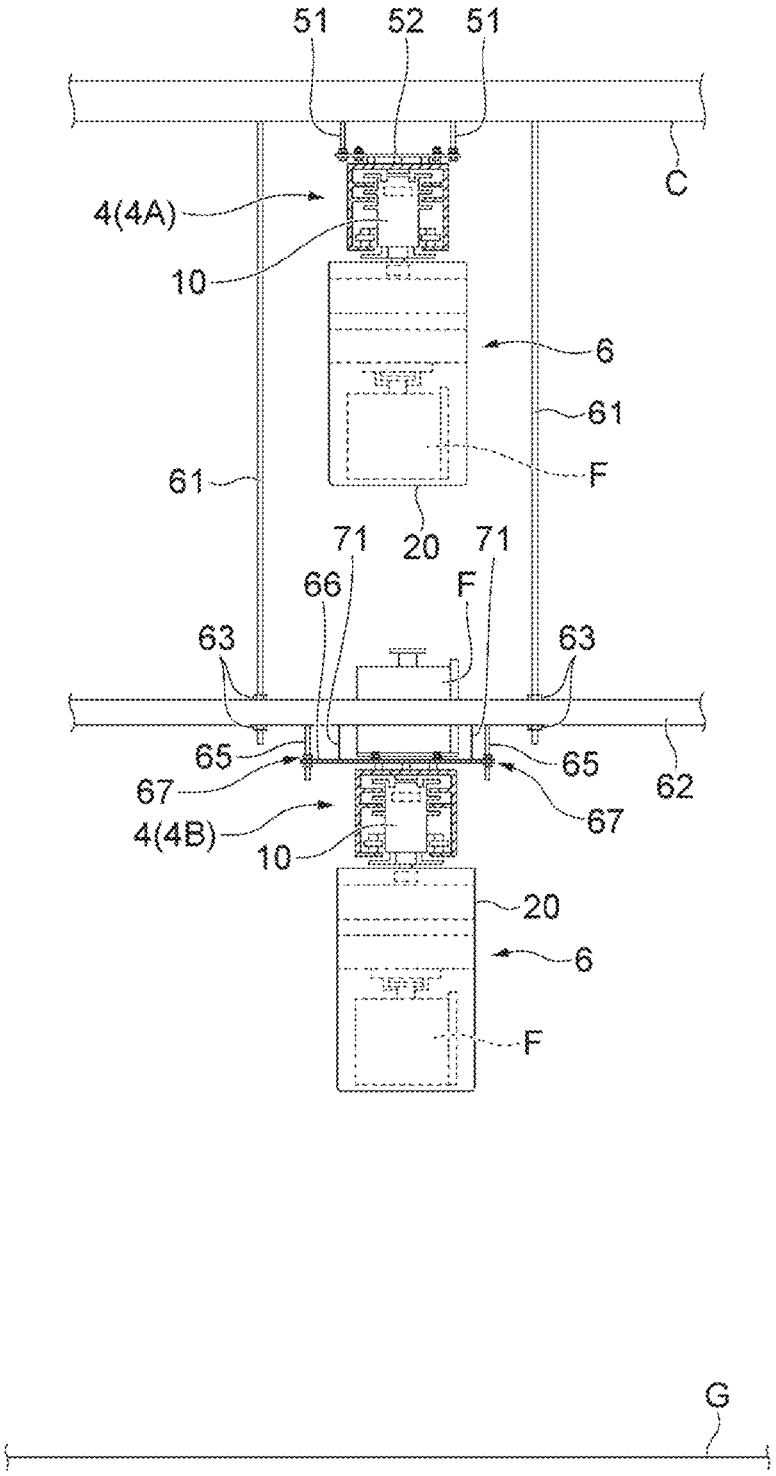
FIG. 6 is a diagram illustrating a schematic configuration of an overhead transport vehicle and a cross-sectional configuration of a track, the vehicle and the track defining an overhead transport vehicle system according to an alternative preferred embodiment of the present invention.

In the overhead transport vehicle system 1 of the above preferred embodiments, examples in which the lower track 4B is disposed at a position not overlapping with the upper track 4A in plan view as viewed from the vertical direction have been described, but the present invention is not limited to this configuration. For example, as illustrated in FIG. 6, the lower track 4B may be disposed at a position overlapping with the upper track 4A in plan view as viewed from the vertical direction.

In the above preferred embodiments and alternative preferred embodiment, examples in which the protrusion 75 is formed by being attached to the attachment groove 43 have been described, but for example, a protrusion to position the article F may be formed directly on the upper surface of the lower track 4B.

In the above preferred embodiments and alternative preferred embodiment, examples have been described in which the placement part 90 that enables the article F to be exchanged between the transport vehicle 6 traveling on the upper track 4A and the transport vehicle 6 traveling on the lower track 4B is installed on the ground G of the building. However, the placement part may be configured to be hung from the ceiling C.

In the above preferred embodiments and alternative preferred embodiment, examples in which the upper ends of the upper hanging members 51, 51 and the upper ends of the hanging members 61, 61 are fixed to the ceiling C have been described, but the present invention is not limited thereto. For example, the fixation of the upper ends of the upper hanging members 51, 51 and the upper ends of the hanging members 61, 61 may be released, whereby the respective upper ends may be fixed to raceways or the like that slidably support the respective upper ends.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An overhead transport vehicle system comprising:

an upper track;

a lower track below the upper track in a vertical direction;

an overhead transport vehicle to travel along the upper track and the lower track; and the overhead transport vehicle system including a placement portion on an upper surface of the lower track and to which an article is transferable from the overhead transport vehicle stopped on the upper track; wherein the upper surface of the lower track includes a protrusion to position the article at a placement position; and the protrusion is attached to a groove extending along an extending direction of the lower track on the upper surface of the lower track.

2. The overhead transport vehicle system according to claim 1, wherein the lower track does not overlap with the upper track in plan view as viewed from the vertical direction.

3. The overhead transport vehicle system according to claim 1, wherein the lower track includes:

a pair of bottom plates spaced from each other in a width direction orthogonal to both an extending direction and a vertical direction of the track;

a pair of side plates extending from the pair of bottom plates; respectively; and an upper plate that connects the pair of side plates in the width direction and defines the upper surface; and a traveling portion of the overhead transport vehicle is operable to travel in a space surrounded by the pair of bottom plates, the pair of side plates, and the upper plate.

4. The overhead transport vehicle system according to claim 1, wherein the lower track is attached to a hanger that hangs and supports the lower track via an inclination adjustment tool.

5. The overhead transport vehicle system according to claim 1, wherein the lower track is attached to a hanger that hangs and supports the lower track via an elastic body.

6. The overhead transport vehicle system according to claim 1, further comprising a fall prevention fence that extends laterally relative to the article placed on the upper surface of the lower track and along an extending direction of the lower track, and is attached to the lower track.

* * * * *